US005269115A

United States Patent [19]

Stentenbach

[11] Patent Number: 5,269,115

[45] Date of Patent: Dec. 14, 1993

[54] DEVICE FOR PLACING A FIBER RIBBON INTO A CAN

[75] Inventor: Udo Stentenbach, Nordhorn, Fed. Rep. of Germany

[73] Assignee: Rosink GmbH + Co. KG, Nordhorn, Fed. Rep. of Germany

[21] Appl. No.: 942,172

[22] Filed: Sep. 4, 1992

[30] Foreign Application Priority Data

Sep. 23, 1991 [DE] Fed. Rep. of Germany ..... 4131599

[51] Int. Cl.[5] ..... B65H 54/80

[52] U.S. Cl. ..... 53/116; 53/430

[58] Field of Search ..... 53/118, 116, 430; 242/82, 83; 226/168

[56] References Cited

U.S. PATENT DOCUMENTS

| | | | |
|---|---|---|---|
| 2,719,338 | 10/1955 | Carmichael . | |
| 3,478,399 | 11/1969 | Wyatt et al. | 53/116 X |
| 3,816,889 | 6/1974 | Crotti | 53/116 |
| 4,392,286 | 7/1983 | Yakushiji et al. | 53/116 X |

FOREIGN PATENT DOCUMENTS

| | | |
|---|---|---|
| 0261330 | 7/1987 | European Pat. Off. . |
| 2923917 | 6/1979 | Fed. Rep. of Germany . |
| 2348288 | 11/1977 | France . |

*Primary Examiner*—James F. Coan

*Attorney, Agent, or Firm*—Robert W. Becker & Associates

[57] ABSTRACT

A device for placing a ribbon into a can includes a frame and a rotary head unit connected to the frame. The rotary head unit includes a rotary head with a turntable that is eccentrically positioned relative to a center axis of the can and rests on layers of fiber ribbon already placed in the can. Two calender rollers are connected to a top side of the turntable. The calender rollers each have an axis of rotation that is slanted relative to the horizontal and form between them a slot for transporting and placing the fiber ribbon in continuous loops into the can. A friction disk is fixedly connected to at least one calender roller. The calender rollers and the friction disk are positioned on the same side of the turntable relative to a plane extending through the central axis of the turntable. An annular surface cooperates with the friction disk for driving the calender roller connected to the friction disk. A support that is pivotably connected to the turntable supports the bearing of the calender roller connected to the friction disk. The device accomplishes a gentle and dust-free guidance of the fiber ribbon and facilitates cleaning and servicing of the device by placing the calender rollers and the friction disk on one side of the turntable and by providing a pivotable support for the friction disk.

11 Claims, 2 Drawing Sheets

DEVICE FOR PLACING A FIBER RIBBON INTO A CAN

BACKGROUND OF THE INVENTION

The present invention relates to a device for placing a fiber ribbon into a can. The device comprises a rotary head unit connected to a frame, the rotary head unit comprising a rotary head with a turntable eccentrically positioned relative to a center axis of the can, whereby the rotary head rests on layers of fiber ribbon already placed in the can. The rotary head unit further comprises two calender rollers connected to the top side of the turntable the calender rollers are slanted relative to the horizontal and transport and place the fiber ribbon in continuous loops into the can. At least one of the calender rollers is fixedly connected to a drive gear which cooperates with an annular surface provided at the rotary head unit.

Such a device for placing a fiber ribbon into a can is known from German Offenlegungsschrift 33 18 944. The fiber ribbon coming from the teasel unit is guided to the rotary head via a roller positioned above the rotary head whereby the fiber ribbon is transported via an inlet funnel to the two calender rollers. The inlet funnel rotates with the circumferential velocity of the rotary head. Accordingly, the fiber ribbon is not only moved in its own transporting direction, but also in the circumferential direction of the rotary head. This results not only in a great mechanical load on the fiber ribbon, but also in an undesirable development of fine textile dust particles.

From the French published document 2 325 589 a device of the aforementioned kind for placing a fiber ribbon into a can is known in which the drive for one calender roller is accomplished by a gear wheel which is located on the same rotating shaft as the calender roller and which cooperates with a downwardly oriented toothed rim of the rotary head unit. The fiber ribbon transported by the calender rollers is guided into a long tube at the bottom end of which the placing of the fiber ribbon into the can is performed. It is disadvantageous that the transportation of the fiber ribbon within the tube downstream of the calender rollers results in a high mechanical load on the fiber ribbon. Furthermore, irregularities of the fiber ribbon transport may occur so that the placing of the fiber ribbon within the can is not necessarily performed with the desired accuracy and neatness. With the prior art device it is also difficult to service the drive means which are subjected to great wear and to replace them, if needed. Such a replacement is necessary when due to increasing wear an unfavorable and undesirable play between the pinion-type drive gear and the toothed rim occurs. There are no measures provided in the prior art to eliminate or adjust such play which increases over time. Finally, soiling of the fiber ribbon with lubricants which are necessary for lubricating the pinion drive may not be prevented completely.

It is therefore an object of the present invention to provide a device of the aforementioned kind which provides for a careful and dust-free guidance of the fiber ribbon and which may be easily cleaned and serviced.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
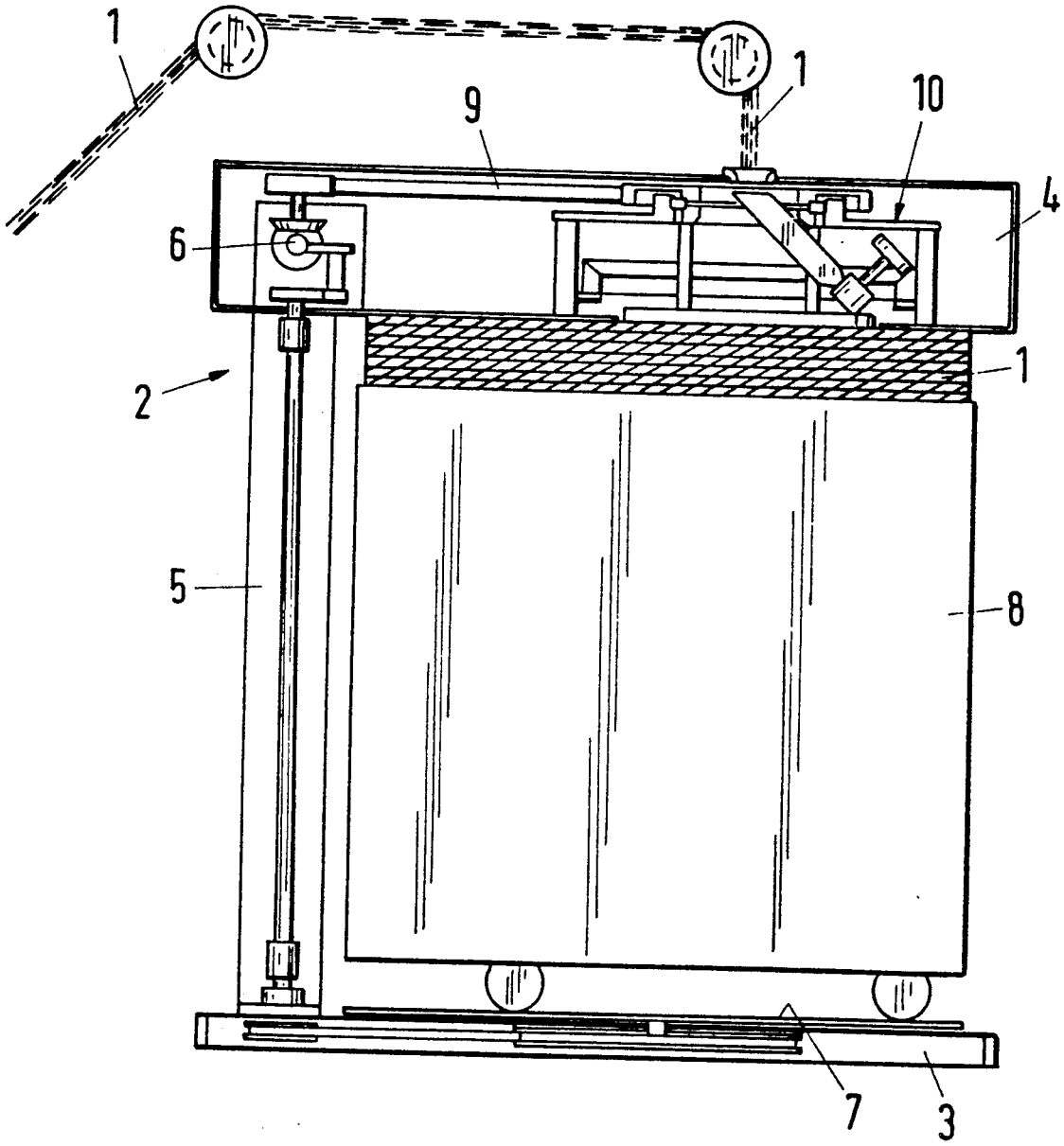
FIG. 1 is a part-sectioned view of a device for placing a fiber ribbon into a can that is rotatably supported.

The device for placing a fiber ribbon into a can according to the present invention is primarily characterized by a frame and a rotary head unit connected to the frame, the rotary head unit comprising:

A rotary head with a turntable, the rotary head eccentrically positioned relative to a center axis of the can and resting on layers of fiber ribbon already placed in the can;

Two calender rollers connected to a top side of the turntable, the calender rollers each having an axis of rotation that is slanted relative to the horizontal and forming therebetween a slot for transporting and placing the fiber ribbon in continuous loops into the can;

A friction disk fixedly connected to at least one of the calender rollers, the one calender roller having a bearing, and the calender rollers and the friction disk positioned on a same side of the turntable relative to a plane extending through the central axis of the turntable;

An annular surface cooperating with the friction disk for driving the one calender roller; and A support pivotably connected to the turntable for supporting the bearing of the one calender roller.

Since the calender rollers, with reference to the plane extending through the central axis of the turntable, are arranged on the same side as the friction disk (drive gear or wheel), a very compact design and construction results in which the bearings are subjected to only very small loads. Furthermore, it is possible to arrange the calender rollers in immediate proximity to the surface of the turntable so that the fiber ribbon after leaving the calender rollers may be placed into the can on the shortest possible path, furthermore avoiding folding within the tube as well as providing for a gentle and dust-free transport.

Since the bearing of the calender roller which is fixedly connected to the friction disk is supported by a support that is pivotably connected to the turntable, cleaning and servicing operations may be easily performed by simply pivoting the constructive unit comprised of the friction disk and the calender rollers. The pivotability of the support further ensures that no play between the annular surface of the rotary head unit and the drive wheel, respectively, the friction disk, occurs. For preventing such play it is furthermore advantageous that the drive wheel, i.e., the friction disk, inherently eliminates possible play commonly present in form-looking designs such as toothed gears or pinions.

In a further embodiment of the present invention, the rotary head unit further comprises a tube connected to the support for guiding the fiber ribbon to the calender rollers. The tube results in an additional improvement of the guidance of the fiber ribbon and especially in a smoother run of the fiber ribbon within the rotary head. Since the tube is directly connected to the support, a further simplification of the construction and especially an improved accessibility for cleaning and servicing operations results.

It is especially advantageous that the axis of the tube extends at a right angle to the rotational axes of the calender rollers. It is furthermore expedient that the tube comprises an air jet nozzle connected to one end of the tube immediately adjacent to the slot formed between the calender rollers, the air nozzle feeding the fiber ribbon into the slot. The stream of air (air jet) exiting from the air jet nozzle engages in a gentle manner the free end of the fiber ribbon and guides it into the slot between the two calender rollers for further transportation.

Expediently, the axis of rotation of the calender rollers are slanted at an angle of between 20° to 70° to the horizontal. With this arrangement the fiber ribbon may be guided to the rotary head along its rotational axis so that swivel movements of the fiber ribbon are limited to the area within the rotary head.

In a preferred embodiment of the present invention, the bearing of the one calender roller connected to the friction disk is connected between this calender roller and the friction disk. This results in only minimal transverse forces at the bearing so that simple and inexpensive bearings may be used.

In order to provide a reliable frictional connection between the friction disk and the annular surface of the rotary head unit it is provided in a further embodiment of the present invention that the support comprises a spring-loaded elbow joint for supporting the support at the turntable. For the spring-loading action of the elbow joint a cup spring package may be used. However, it is also possible to use a pneumatic spring, the advantage of which is a constant pressure applied to the friction disk.

It is furthermore suggested that in a bent position of the elbow joint, the friction disk is removed from the annular surface, i.e., it is disengaged. In this manner, after bending of the elbow joint servicing, maintenance and repair operations at the calender rollers, the friction disk, the bearing, or the air jet nozzle may be easily performed.

Since with the inventive device the fiber ribbon may be centrally guided into the rotary head, it is furthermore suggested that the diameter of the bearing means of the rotary head is smaller than the diameter of the turntable. In this manner it is possible to use a roller bearing of a small diameter for the support of the rotary head. This results in a smooth and quiet run of the rotary head within the rotary head unit.

In a further embodiment of the present invention it is suggested that the annular surface is conically shaped and the friction disk contacts the upper side of the conically shaped annular surface. This results in an especially compact construction as well as in a great accessibility of the moving parts of the device.

DESCRIPTION OF PREFERRED EMBODIMENTS

The present invention will now be described in detail with the aid of several specific embodiments utilizing FIGS. 1 and 2.

FIG. 1 shows a side view of an inventive device for placing a fiber ribbon 1 into a can 8. The device is arranged downstream of a teasel arrangement not represented in the drawing. The device comprises a frame 2 with a base plate 3, a rotary head unit 4 and a column 5 connecting the rotary head unit 4 to the base plate 3. The device is driven via a drive pinion 6 within the rotary head unit 4 which along a first drive path drives the turntable 7 supported at the base plate 3. A cylindrical can 8 is positioned on the turntable 7 for receiving the fiber ribbon 1. Along a further drive path the rotational movement of the drive pinion 6 is transmitted via a drive belt 9 onto the rotary head 10 which is vertically supported within the rotary head unit 4. The rotary head 10 performs a continuous rotational movement within the rotary head unit 4 whereby this rotational movement is superimposed on the rotational movement of the turntable 7 receiving the can 8. Since the rotary head 10 is eccentrically positioned relative to the longitudinal axis of the can 8 this superimposed rotational movement results in the placement of the fiber ribbon 1 in continuous loops within the can 8. The fiber ribbon 1 which has already been placed into the can 8 is loaded from the bottom by a pressure force generated by a spring so that the uppermost layer of the fiber ribbon 1 is always in direct contact with the bottom side of the rotary head unit 4, respectively, the rotary head 10.

Figure 2:
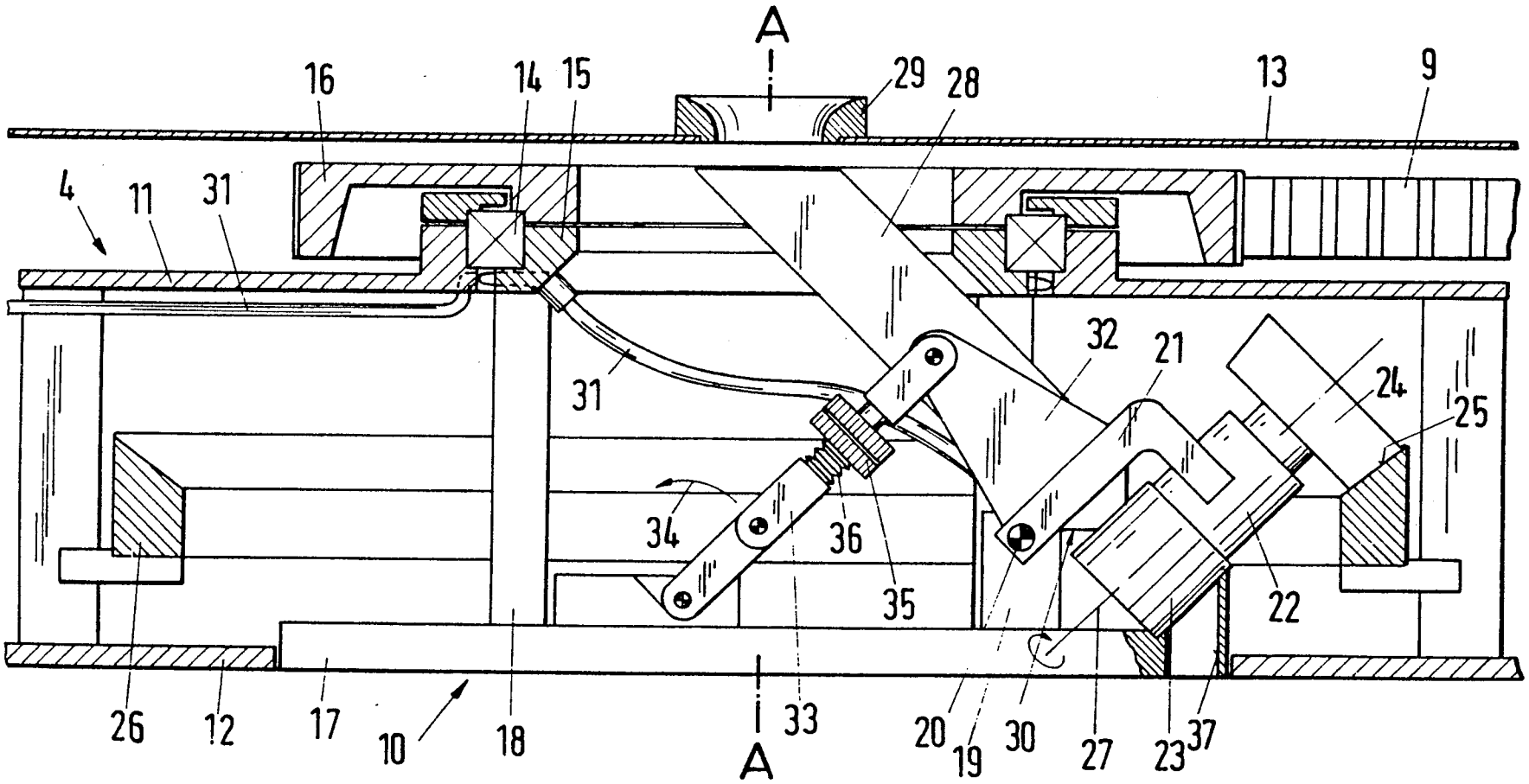
FIG. 2 is a detailed representation the rotary head unit of FIG. 1 with the rotary head inserted therein.

FIG. 2 shows that the rotary head device 4 is essentially comprised of two stationary horizontal plates 11, 12 and a cover 13. The rotary head 10 is supported by a roller bearing 14 within the upper plate 11. The rotary head 10 is comprised of an inner bearing ring 15, a belt pulley 16 mounted on the bearing ring 15 and carrying the drive belt 9, and a turntable 17 which is rotatable about its center axis A. The turntable 17 is connected via a plurality of vertical stays 18 to the inner bearing ring 15. The bottom side of the turntable 17 and the bottom side of the lower plate 12 of the rotary head unit 4 are aligned in the same plane and are in direct contact with the uppermost layer of the fiber ribbon 1 (not represented in FIG. 2).

At the top side of the turntable 17 a support 21 that is pivotable about a pivot joint 20 is connected to a bearing block 19. The support 21 is comprised of a L-shaped angle piece, the short leg of which supports the bearing or bearing sleeve 22. Within the bearing sleeve 22 an axle is rotatably supported by two small roller bearings. A first calender roller 23 is connected to the one end of the axle and a friction disk 24, fixedly connected to the first calender roller 23, is supported on the other end of the axle. The bearing sleeve 22, the calender roller 23 as well as the friction disk 24 form a compact constructive unit and are located on the same side relative to a plane through the central axis A of the turntable 17. Due to the compact construction the bearing sleeve 22 is subjected to only small bearing forces. The calender rollers 23 are located closely above the upper end of the can 8 so that the fiber ribbon 1 must only travel a short path to the can 8.

The friction disk 24 is comprised of polyurethane and is in frictional contact with an annular surface 25 of the rotary head unit 4. This annular surface 25 faces upward and is concentric to the rotary head 10. The annular surface 25 is embodied as a conical ring 26 which is fixedly supported within the rotary head unit 4.

Not represented in FIG. 2 is a second calender roller positioned behind the first calender roller 23 which has the same design as the first calender roller 23. The second calender roller is also connected to the support 21 and is thus pivotable about the pivot joint 20. Between the two calender rollers a slot with an adjustable width is provided.

The rotational axis 27 (shown in FIG. 2) of the first calender roller 23 as well as of the second calender roller exhibit a distinct slant relative to the horizontal. In the embodiment shown in FIG. 2 the angle of slant of the rotational axis 27 is approximately 45°.

A tube 28 is connected to the support 21 such that its axis is aligned with the slot between the two calender rollers and, as shown in the drawing, is approximately perpendicular to the rotational axis 27 of the calender rollers. Accordingly, the tube 28 is also slanted at an angle of approximately 45° to the horizontal. The upper opening of the tube 28 opens directly below the inlet funnel 29 provided at the cover 13. The upper opening of the tube 28 as well as the inlet funnel 29 are located exactly on the axis of rotation of the rotary head 10.

The tube 28 tapers off at its bottom end, in the immediate vicinity of the two calender rollers and forms a nozzle SO. The nozzle 30 is provided with an air jet nozzle, not represented in the drawing, which is connected via compressed air line 31 to a compressed air source.

FIG. 2 further shows that the support 21 is pivotably coupled with an angle piece 32 connected to the support 21 to an elbow joint 33. The elbow joint 33 can be moved manually in the direction of arrow 34 so that the effective length of the elbow joint 33 which is pivotably supported at the turntable 17 may be shortened. This results in a reciprocation of the support 21 together with the first calender roller 23 and the friction disk 24. Simultaneously, the tube 28 which is connected to the support 21 is also reciprocated into a horizontal position. Via two knurled lock nuts 35 a fine adjustment of the length of the elbow joint 33 is possible. A cup spring package 36 generates a pressure force within the elbow joint 33 and results in an artificial pressure force of the conically shaped friction disk 24 onto the correspondingly conically shaped annular surface 25.

During operation of the device the fiber ribbon, not represented in FIG. 2, is guided via the inlet funnel 29 into the tube 2S at the bottom end of which the beginning of the fiber ribbon 1 is engaged by the air jet from the air jet nozzle and inserted into the slot between the first calender roller 23 and the second calender roller. After this insertion step the further transport of the fiber ribbon 1 with the aid of the two calender rollers takes place. Only the first calender roller 23 is directly driven via the friction disk 24 that is contacting the annular surface 25, while the second calender roller, not represented in FIG. 2, is a free-wheeling roller and turns only due to the friction generated by the fiber ribbon 1. After passing through the slot between the calender rollers the fiber ribbon 1 is fed via an opening 37 within the turntable 17 along a short path into the can 8 and is horizontally placed therein.

The present invention is, of course, in no way restricted to the specific disclosure of the specification and drawings, but also encompasses any modifications within the scope of the appended claims.

What I claim is:

1. A device for placing a fiber ribbon into a can, said device comprising:

a frame; and a rotary head unit connected to said frame, said rotary head unit comprising:

a) a rotary head with a turntable, said rotary head eccentrically positioned relative to a center axis of the can and resting on layers of fiber ribbon already placed in the can;

b) two calender rollers connected to a top side of said turntable, said calender rollers each having an axis of rotation that is slanted relative to the horizontal and forming therebetween a slot for transporting and placing the fiber ribbon in continuous loops into the can;

c) a friction disk fixedly connected to at least one of said calender rollers, said one calender roller having a bearing, and said calender rollers and said friction disk positioned on a same side of said turntable relative to a plane extending through the central axis of said turntable;

d) an annular surface cooperating with said friction disk for driving said one calender roller;

e) a support pivotably connected to said turntable for supporting said bearing of said one calender roller; and f) a tube connected to said support for guiding the fiber ribbon to said calender rollers.

2. A device according to claim 1, wherein said support further comprises a pivot joint with which pivot joint said support is connected to said turntable on said same side of said turntable relative to a plane extending through the central axis of said turntable as said calender rollers and said friction disk.

3. A device according to claim 1, wherein the axis of said tube extends at a right angle to said rotational axes of said calender rollers.

4. A device according to claim 3, wherein said tube comprises an air jet nozzle connected to the end of said tube immediately adjacent to said slot formed between said calender rollers, said air jet nozzle feeding the fiber ribbon into said slot.

5. A device according to claim 1, wherein said rotational axes of said calender rollers are slanted at an angle of between 20° to 70° to the horizontal.

6. A device according to claim 1, wherein the fiber ribbon is fed into said rotary head at its rotational axis.

7. A device according to claim 1, wherein said bearing of said one calender roller is connected between said one calender roller and said friction disk.

8. A device according to claim 1, wherein said support comprises a spring-loaded elbow joint for supporting said holder at said turntable.

9. A device according to claim 8, wherein, in a bent position of said elbow joint, said friction disk is removed from said annular surface.

10. A device according to claim 1, wherein a bearing means of said rotary head is smaller than the diameter of said turntable.

11. A device according to claim 1, wherein said annular surface is conically shaped and wherein said friction disk contacts the upper side of said conically shaped annular surface.

* * * * *